US005085730A

United States Patent [19]

Cordani

[11] Patent Number: 5,085,730

[45] Date of Patent: Feb. 4, 1992

[54] PROCESS FOR REGENERATING AMMONIACAL CHLORIDE ETCHANTS

[75] Inventor: John L. Cordani, Waterbury, Conn.

[73] Assignee: MacDermid, Incorporated, Waterbury, Conn.

[21] Appl. No.: 614,725

[22] Filed: Nov. 16, 1990

[51] Int. Cl.[5] ..... B44C 1/22; C23F 1/00; C23C 1/12; C25B 15/00

[52] U.S. Cl. ..... 156/642; 156/656; 156/666; 156/345; 204/106; 204/237

[58] Field of Search ..... 156/642, 656, 659.1, 156/666, 345; 252/79.4; 204/105 R, 106, 107, 108, 130, 234, 237, 268, 269, 270; 134/10, 13, 108, 109

[56] References Cited

U.S. PATENT DOCUMENTS 3,784,455 1/1974 Parikh et al. ..... 156/642 X
4,564,428 1/1986 Furst ..... 204/107
4,576,677 3/1986 Faul et al. ..... 156/642
4,784,785 11/1988 Cordani et al. ..... 252/79.4
4,915,776 4/1990 Lee ..... 156/642
4,944,851 7/1990 Cordani et al. ..... 156/642 X
4,957,611 9/1990 Collini ..... 204/106

*Primary Examiner*—William A. Powell
*Attorney, Agent, or Firm*—St. Onge Steward Johnston & Reens

[57] ABSTRACT

A process is described for the direct electrolytic regeneration of chloride-based ammoniacal copper etchants without generating any significant amount of gaseous chlorine. The electrolysis is carried out using an etch resistant metal cathode and an anode which can be carbon, or an etch resistant metal optionally coated with a noble metal oxide. The process can be adapted to a closed loop system for maintaining at a substantially constant level the amount of copper present in an operating ammoniacal chloride etchant bath.

11 Claims, 2 Drawing Sheets

PROCESS FOR REGENERATING AMMONIACAL CHLORIDE ETCHANTS

FIELD OF THE INVENTION

This invention relates to chloride-based ammoniacal copper etchant baths and is more particularly concerned with a process for direct regeneration of such baths and a closed loop system for maintaining the same in operable condition for prolonged periods.

BACKGROUND OF THE INVENTION

The etching of copper is a step carried out in a variety of production processes. A particular example is found in the manufacture of circuit boards which generally begins with a non-conducting substrate such as a phenolic or glass reinforced epoxy sheet laminated on one or both sides with a layer of copper foil. An etch resist image in the shape of a desired circuit pattern is applied to the copper foil and the foil so imaged is subjected to the action of an etchant, by spraying or immersion, to remove the copper not covered by the etch resist. The resist-covered copper circuit pattern is thereby caused to stand out in vertical relief.

The etchants most widely used commercially are cupric chloride alkaline ammoniacal solutions because they provide high etch rates. A major drawback of this type of etchant lies in the difficulty of treating and disposing of the waste therefrom. Electrolytic attempts to recycle or regenerate such baths directly have hitherto been largely unsuccessful due to the corrosive nature of the etchant and the large amounts of chlorine gas which are generated.

Efforts have been made to employ cupric sulfate alkaline ammoniacal etchants since these can be regenerated by electrolytic means without generating chlorine gas. However, these sulfate-based baths suffer from low etch rates. Cordani et al U.S. Pat. No. 4,784,785 reviews prior attempts to increase the etch rate of these baths and describes the use of organic thio compounds to accelerate the etch rate. However, the accelerated rate so achieved is still significantly less than that of chloride based etchants.

Attempts to regenerate chloride-based etchants using processes which do not generate chlorine gas are reviewed in Lee U.S. Pat. No. 4,915,776, the teachings of which are incorporated herein by reference. These various attempts include electrolytic recovery of the copper content by indirect techniques. The '776 patent is also directed to a process of treating spent etchant. The process involves precipitating copper as a copper hydroxide sludge by reaction with calcium hydroxide. The ammonia gas which is also generated in the reaction is then reacted with the aqueous calcium chloride solution (remaining after the precipitation) and carbon dioxide gas to generate an aqueous solution of ammonium hydroxide and ammonium chloride and a precipitate of calcium carbonate. After separation of the latter, the remaining solution is used to formulate a fresh etchant bath. This process requires high initial investment in complex equipment as well as further treatment to recover metallic copper from the hydroxide precipitate.

Furst et al U.S. Pat. No. 4,564,428 describes a process for regenerating a sulfate-based ammoniacal copper etchant bath by electrolytic means in the presence of a small amount of ammonium chloride. The oxygen generated at the anode is said to prevent evolution of chlorine gas.

It has now been found that it is possible to regenerate chloride-based ammoniacal copper etchant baths by direct electrolytic means without generation of any significant amount of chlorine. It has been found further that copper can be recovered from the etchant bath in the form of ductile sheets which can be stripped from the cathode in the electrolytic regeneration.

SUMMARY OF THE INVENTION

It is an object of the invention to regenerate chloride-based ammoniacal copper etchant baths by direct electrolytic means substantially without generation of chlorine gas. It is a further object of the invention to recover copper in ductile sheet form from chloride-based ammoniacal copper etchant baths. It is yet another object of the invention to provide a closed loop system for maintaining a chloride-based ammoniacal copper etchant bath in operating condition for a prolonged period of time by continuously removing liquid from said bath, subjecting the liquid so removed to direct electrolytic regeneration and returning regenerated bath liquid to the main bath on a continuous basis.

These objects, and other objects which will become apparent from the description which follows, are achieved by the process of this invention. The latter, in its broadest aspect, comprises a process for the electrolytic regeneration of a chloride-based ammoniacal copper etchant bath substantially without generating gaseous chlorine wherein the bath is subjected to direct electrolysis employing an etch resistant metal cathode and an anode which can be carbon, or an etch resistant metal optionally coated with a layer of a conductive noble metal oxide. Copper is deposited on the cathode in the form of a peelable ductile sheet.

In a particular aspect, the invention also comprises a closed loop system for maintaining a chloride-based ammoniacal copper etchant bath in operable condition by constantly removing liquid from the bath, on a continuous or semi-continuous basis, subjecting the withdrawn liquid to electrolytic regeneration using the above process, and returning regenerated liquid to the etchant bath to maintain the latter at constant volume and cupric ion content.

DETAILED DESCRIPTION OF THE INVENTION

Chloride-based ammoniacal copper etchant baths generally comprise aqueous solutions containing, as the main components, a cupric ammonium chloride complex and ammonium hydroxide. As the etching process proceeds, the cupric ammonium chloride gradually increases in concentration. When the cupric ion concentration reaches a certain level, generally of the order of about 150 g./liter, the rate at which further etching will take place becomes significantly reduced. When this point is reached it is necessary either to prepare a fresh etchant bath and dispose of the previous one or, preferably, to restore the etch rate of the bath to its former level. In order to achieve the latter result it is necessary to regenerate the bath by reducing the copper content below the above level, and advantageously to a level below about 100 g./liter, without significantly altering the nature and/or concentrations of the other components of the bath. This desirable result is achieved by the process of the invention.

Figure 1:
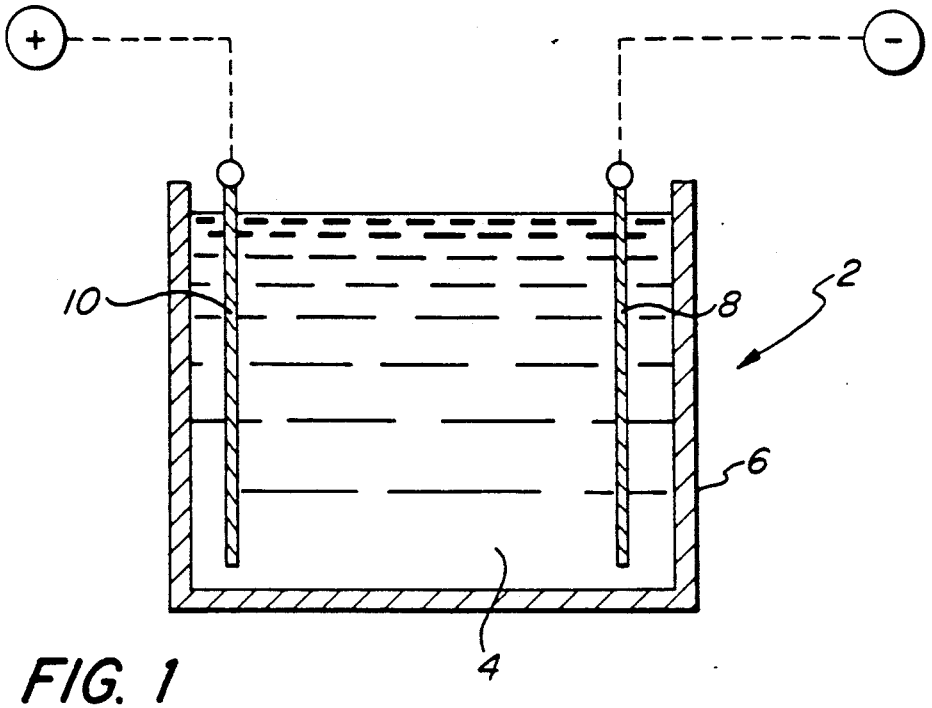
FIG. 1 shows in schematic form an electrolytic cell for use in the process of the invention.
Figure 2:
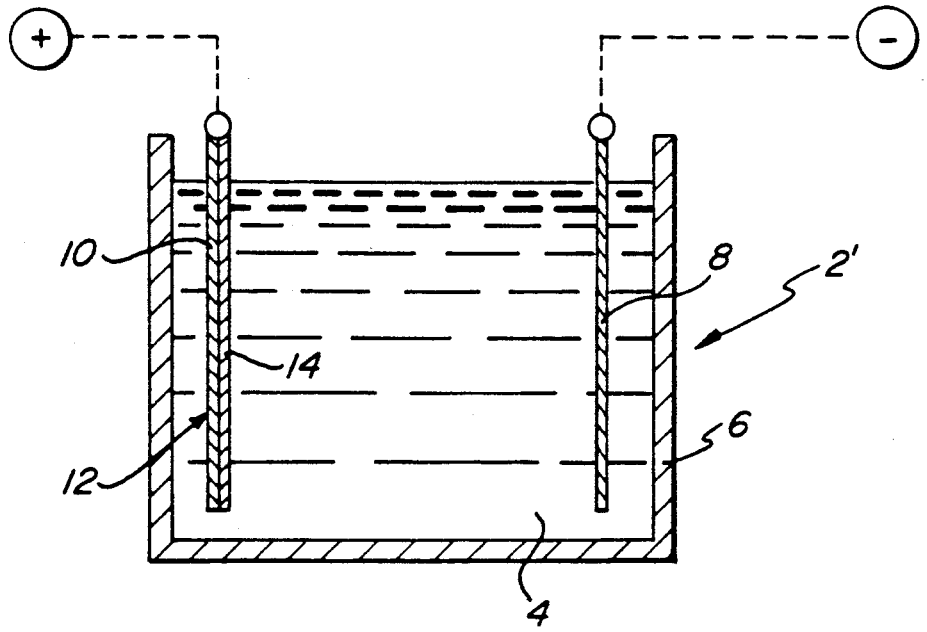
FIG. 2 shows in schematic form another embodiment of an electrolytic cell for use in the process of the invention.

FIG. 1 shows in schematic form a typical cell arrangement, shown overall as (2), in which to carry out the process of the invention. The etchant bath liquid (4) to be regenerated is held in cell (6) which is provided with cathode (8) and anode (10). Cathode (8) is fabricated from an etchant resistant metal such as platinum, palladium, titanium, tantalum, niobium, and the like. Anode (10) is fabricated from carbon or an etch resistant metal, which can be the same as or different from that used as cathode. A particular embodiment of a cell arrangement in accordance with the invention is shown overall as (2') in FIG. 2 in which elements common to FIGS. 1 and 2 are shown by the same numerals. In the embodiment shown in FIG. 2, anode (10) comprises a sheet (12) of an etchant resistant metal, which can be the same as or different from that employed as cathode, on one or both sides of which is a coating (14) of a conductive noble metal oxide. Illustrative of such oxides are the oxides of iridium, ruthenium, gold, platinum, palladium, and the like. The cathode (8) and anode (10) are shown in both embodiments as planar sheets or plates, but it is to be understood that they can be of any shape conventionally employed in the art.

Coated anode plates of the type called for above are available commercially, for example, from Eltech Inc. of Chardon, Ohio.

In operation of the cell (2) or (2') as shown in either of the embodiments discussed above, the temperature of the bath is advantageously maintained in the range of about 70° F. to about 170° F. and preferably in the range of about 70° F. to about 90° F. The pH of the bath liquid is advantageously in the range of about 7.8 to about 9.5 and preferably in the range of about 8.0 to about 8.2. The current density employed is advantageously in the range of about 10 to about 300 amp/sq.ft. (ASF) and preferably in the range of about 70 to about 150 ASF. As the electrolysis proceeds, copper is deposited in sheet form on the cathode (8). The electrolysis is continued until the level of copper in the bath liquor has fallen to a desired level generally of the order of about 60 g./liter. At this time the etchant liquid remaining in the cell is ready for re-use. The copper sheet deposited on the cathode (8) can be removed readily by peeling in the form of a ductile sheet.

Figure 3:
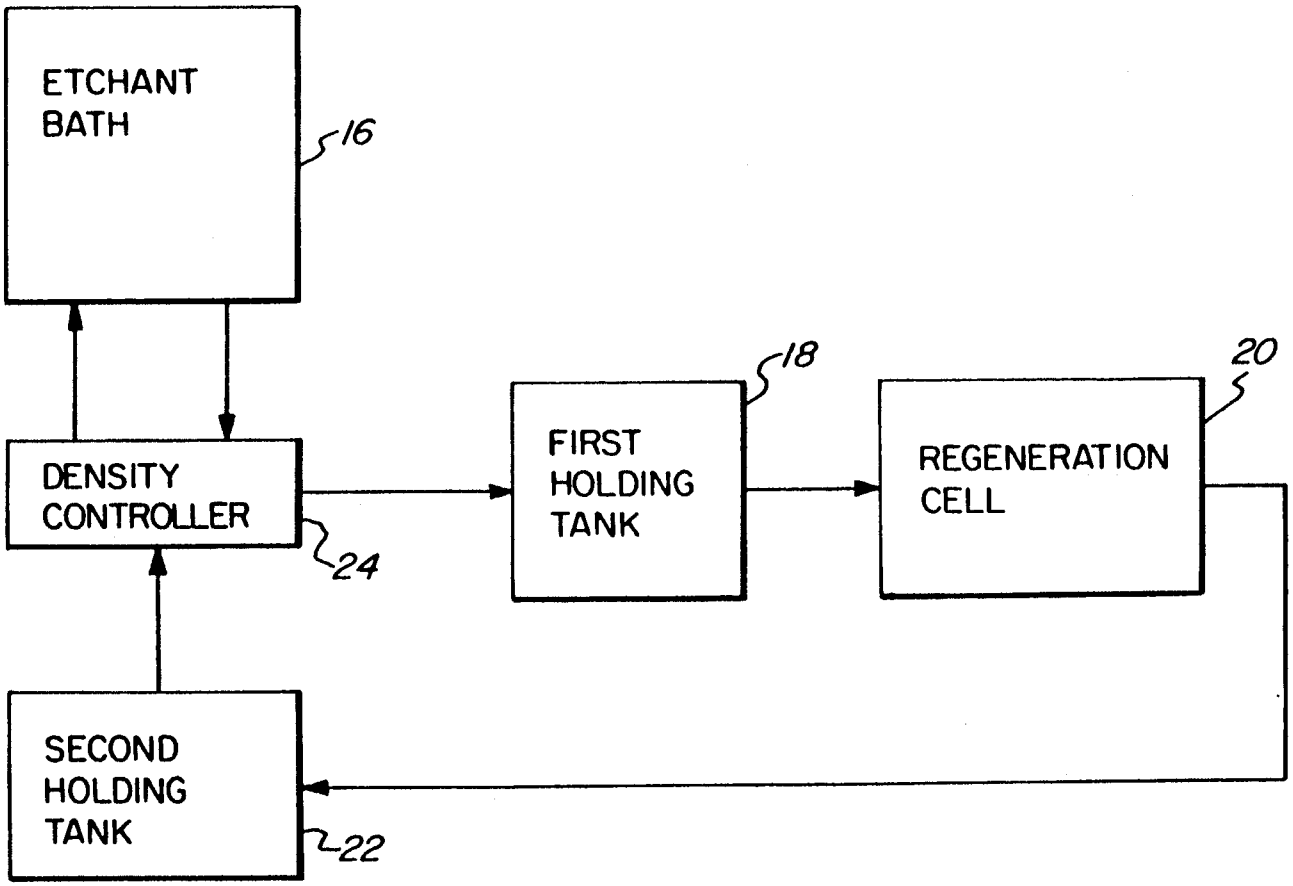
FIG. 3 shows in schematic form a closed loop system employing the process of the invention.

FIG. 3 shows in schematic form a closed loop system in which the electrolytic regeneration process of the invention is employed to treat etchant bath liquor withdrawn from an operating etchant bath and regenerated etchant is returned to the latter. In the system shown, liquid is withdrawn from operating etchant bath (16), on a continuous or semi-continuous basis, and transferred to a first holding tank (18). The liquid in tank (18) is regenerated in cell (20) in increments corresponding to the capacity of the cell. Cell (20) is operated in accordance with the invention as described above in regard to the embodiment shown in FIG. 1 or 2. The electrolysis of each increment is continued until the copper concentration in the liquid has fallen to a predetermined level, typically of the order of about one-half of the copper concentration in bath (16). When this point is reached the regenerated etchant is transferred to second holding tank (22) where it is stored with increments already processed. Regenerated etchant is transferred on a continuous or semi-continuous basis as required, to the operating etchant bath (16). The amount of regenerated fluid returned to bath (16) at a given time is equal to the amount withdrawn for regeneration at the same time.

Density controller (24) constantly monitors the density of etchant bath (16). The bath density is directly related to the cupric ion concentration. When a change in bath density indicates that the cupric ion concentration has increased to a predetermined level, controller (24) generates signals which activate the appropriate pump means which cause a portion of bath (16) to be transferred to first holding tank (18) and an equal portion of regenerated bath liquor to be transferred from second holding tank (22) to bath (16). The cupric ion content of bath (16) is thereby reduced to a predetermined level and operation of the etchant bath continues until controller (24) again detects the incremental rise in density and again activates the above described cycle. The employment of density controller (24) in this manner is well-known in the art and, accordingly, further discussion of the nature of the electronic components, circuitry, and calibration of the equipment involved therein is omitted. Illustrative of density controllers and related electronic componentry available commercially is the DSX-2 Density Controller available from MacDermid, Incorporated of Waterbury, Conn.

The direct electrolytic regeneration process of the invention has a significant number of advantages. The cell arrangement is compact, economical and efficient. Substantially no toxic chlorine gas is generated at the anode, in direct contrast to attempts previously made to regenerate chloride-based ammoniacal copper etchants. Further, no waste products which require disposal are generated since both the copper sheet recovered in the process and the regenerated etchant can be recycled. Other systems employed to recover copper from etchant baths by electrolysis have generally deposited the copper in the form of a powder which is much more difficult to separate and handle. As discussed above, the process of the invention has the further advantage that it can be incorporated in a closed loop etchant system which enables an operating etchant bath to be maintained at a constant etch rate over prolonged periods. Further, the process of the invention can be carried out using pH values in the etchant at the low level of about 7.8 to 8.5. This allows the etchant to be used in etching inner layers which utilize organic etch resists sensitive to higher pH.

It is to be understood that the various embodiments of the invention which have been shown and discussed above, have been described for illustration only and are not to be construed as limiting. Various modifications which can be made to the process and system without departing from the scope of the invention will be readily apparent to one skilled in the art.

What is claimed is:

1. A process for the direct electrolytic regeneration of a chloride-based ammoniacal copper etchant bath substantially without generating gaseous chlorine, which process comprises subjecting said bath to electrolysis employing an etch resistant metal cathode and an anode selected from the group consisting of carbon, an etch resistant metal, and an etch resistant metal coated with a layer of a conductive noble metal oxide.

2. A process according to claim 1 wherein the cathode is a titanium sheet.

3. A process according to claim 1 wherein the anode comprises a sheet of titanium coated on at least one side with a layer of an oxide of iridium, ruthenium, platinum, palladium or gold.

4. A process according to claim 1 wherein said electrolytic regeneration is continued until the level of copper in said etchant bath has been reduced to a predetermined level.

5. A process according to claim 4 wherein copper deposited on said cathode in said electrolysis is thereafter removed from said cathode in the form of a ductile sheet.

6. In a process for maintaining the copper content of a chloride-based ammoniacal copper etchant bath at a substantially constant predetermined level during continuous operation of said bath, the steps comprising:

(a) periodically withdrawing a portion of said bath;

(b) subjecting said portion so withdrawn to electrolytic regeneration in accordance with the process of claim 1 until the copper content has been reduced to a predetermined level; and (c) thereafter returning to said bath the said portion, or a similar portion previously withdrawn and regenerated.

7. A process according to claim 6 wherein the withdrawal of etchant from said bath and the return to said bath of regenerated etchant is carried out on a continuous basis.

8. A process according to claim 7 wherein the etchant continuously withdrawn from said bath is transferred to a first storage means, portions are fed from said first storage means to the vessel in which the electrolytic regeneration is carried out and the etchant so regenerated is fed to second storage means from which it is continuously withdrawn and returned to said bath at a rate corresponding to that at which etchant is being withdrawn from said bath to said first storage means.

9. A process for recovering copper in sheet form from a chloride-based ammoniacal copper etchant bath which comprises subjecting said bath to electrolysis in a cell using an etch resistant metal cathode and an anode selected from the group consisting of carbon, an etch resistant metal, and an etch resistant metal coated with a layer of a conductive metal oxide, to deposit copper on said cathode, and thereafter peeling the deposit of copper from said cathode.

10. A process according to claim 9 wherein the cathode is a sheet of titanium.

11. A process according to claim 10 wherein the anode is a sheet of titanium coated on at least one side with a layer of an oxide of iridium, ruthenium, platinum, palladium or gold.

* * * * *